United States Patent [19]

Carré et al.

[11] Patent Number: 4,522,576

[45] Date of Patent: Jun. 11, 1985

[54] VOLUMETRIC MACHINE WITH CONICAL SCREWS

[75] Inventors: Jean-Jacques Carré, Le Raincy; Pierre Courbot, Villiers le Bel, both of France

[73] Assignee: Societe Anonyme D.B.A., Paris, France

[21] Appl. No.: 562,653

[22] Filed: Dec. 19, 1983

[30] Foreign Application Priority Data

Dec. 23, 1982 [FR] France ..... 82 21686

[51] Int. Cl.[3] ..... F04C 18/107

[52] U.S. Cl. ..... 418/194; 418/152; 418/178; 418/201

[58] Field of Search ..... 418/152, 178, 179, 194, 418/201

[56] References Cited

U.S. PATENT DOCUMENTS

| | | | |
|---|---|---|---|
| 2,745,643 | 5/1956 | Kleinlein | 418/201 |
| 3,139,834 | 7/1964 | Blomgren | 418/152 |
| 3,179,330 | 4/1965 | MacColl | 418/201 |
| 4,362,480 | 12/1982 | Suzuki | 418/152 |

FOREIGN PATENT DOCUMENTS

| | | |
|---|---|---|
| 1075148 | 11/1954 | France . |
| 1216086 | 4/1960 | France . |
| 384355 | 12/1932 | United Kingdom . |
| 576603 | 4/1946 | United Kingdom . |

*Primary Examiner*—Leonard E. Smith
*Assistant Examiner*—Jane E. Obee
*Attorney, Agent, or Firm*—Larry J. Palguta; Ken C. Decker

[57] ABSTRACT

The rotors (M, F) each have a conical outer profile and a constant pitch diameter, the rotors being mounted in opposition in the housing (1) with their axes (2, 3) parallel and their pitch diameters tangent (4). The grooves (5) of the female rotor (F) have a radial depth, in relation to the pitch diameter, which varies in inverse proportion to the outside diameter of the female rotor (F), and which, more specifically, have a circular cross-section the radius of which increases progressively in the direction of reduction of the outside diameter of the female rotor, the center of these radii remaining on the pitch diameter. The rotors are produced advantageously by molding a plastic or by casting a light alloy.

8 Claims, 7 Drawing Figures

VOLUMETRIC MACHINE WITH CONICAL SCREWS

The present invention relates to volumetric machines or screw compressors.

Screw compressors conventionally incorporate at least one interacting pair of rotors with intermeshing helical threads and having parallel axes, which are located in intercommunicating chambers of a housing. In practice, the rotors have a general straight cylindrical configuration, the radial depths of the grooves of the female rotor and the radial extensions of the lobes of the male rotor being constant over the entire length of the evolute of the thread. It is well known that this type of volumetric machine presents difficult problems regarding the tolerance of the dimensions of the threads and regarding the mutual adjustment of the rotors to obtain a specific play, generally very slight, between the threads.

The object of the present invention is to propose an arrangement of a volumetric machine with rotating screws, which makes it possible to adjust easily the plays between the threads by utilizing the possibility of relative positioning of the two rotors and a self centering ability of the rotors. For this purpose, according to a feature of the invention, the volumetric machine with screws, of the type incorporating at least two rotors with intermeshing helical threads and having parallel axes, which are located in intercommunicating chambers of a housing having an inlet and an outlet, the rotors each having a conical outer profile, is characterized in that each rotor has a constant pitch diameter and in that the rotors are mounted in opposition in the housing with their pitch diameters tangent.

Rotors of volumetric machines with conical screws have already been proposed. Thus, French Patent Application No. 2,253,930 describes a compressor, each rotor of which has, at rest, that is to say in a non-expanded state, an outer profile, the diameter of which is reduced progressively from the compressor admission side towards the exhaust side in order specifically to allow for problems of differential expansion during operation. Moreover, French Patent Application No. 2,436,876 describes a volumetric machine designed in such a way that the cross-section of the helical grooves varies continuously between the admission side and the delivery side, the rotors having for this purpose a core profile varying progressively in the same direction for both rotors and, if appropriate, an outer profile which varies in the opposite direction, but likewise in the same direction for both rotors, between the admission and delivery ends.

In contrast to these prior techniques, the arrangement according to the invention makes use of two conical rotors of the same conicity, which are mounted in opposition, that is to say with the part of large diameter of one of the rotors corresponding to the part of small diameter of the other rotor, and vice versa, each rotor having a constant pitch diameter and the two rotors being put in position in the housing in such a way that the pitch diameters are tangent.

By means of this arrangement, it is possible to carry out adjustment of the relative axial positioning of the two rotors in order to obtain the desired play between the threads for the purpose of determining exact axial dimensions of the two rotors, guaranteeing that the geometrical characteristics can be reproduced in mass production, by making use of the slope resulting from the difference in the dimensions between the ends of each rotor, the directions of these slopes being complementary when the two rotors are assembled in place. Furthermore, the equipment of the rotors is self-centered as a result of the conicity of the outside diameters, thus making it possible to carry out accurately the centering of this equipment in the housing.

According to another feature of the invention, the female rotor has a groove profile, of which the radial depth in relation to the pitch diameter varies in inverse proportions to those of the outside diameter. More specifically, the grooves of the female rotor thus have a constant radial extension, that is to say the diameter of the core of each rotor has the same conicity, and in the same direction, as the outside diameter of the threads of this rotor.

Other features and advantages of the present invention will emerge from the following description of an embodiment given as an illustration but in no way limiting, the description being made with reference to the attached drawings in which.

Figure 1:
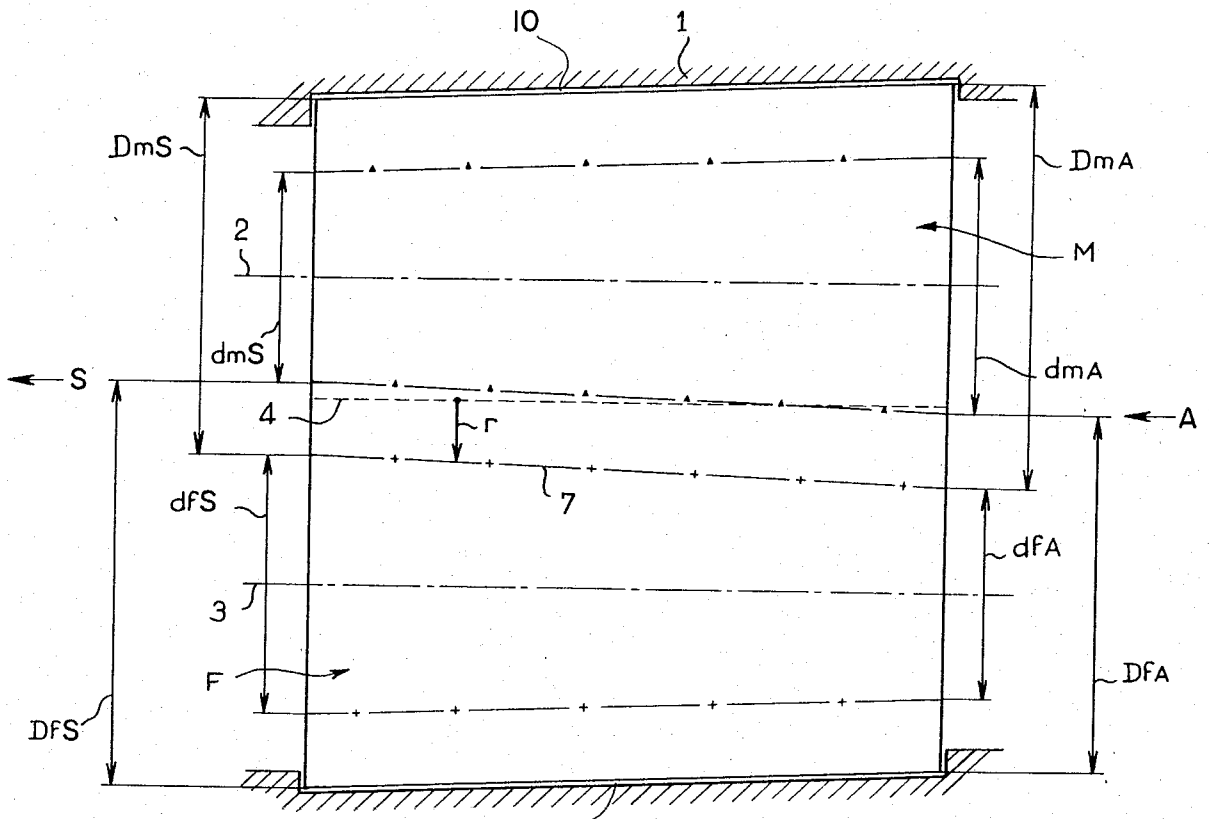
FIG. 1 is a diagrammatic view in longitudinal section of a volumetric machine with screws according to the invention.
Figure 4:
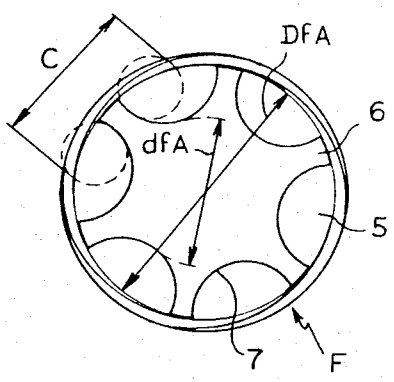
FIGS. 3 and 4 are the two end views of the female rotor.
Figure 5:
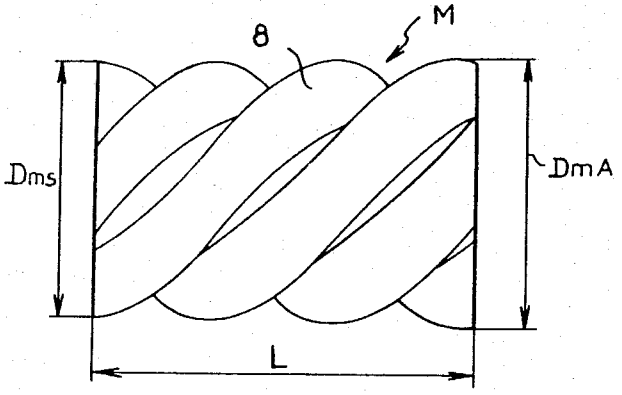
FIG. 5 is a side view of the male rotor.
Figure 2:
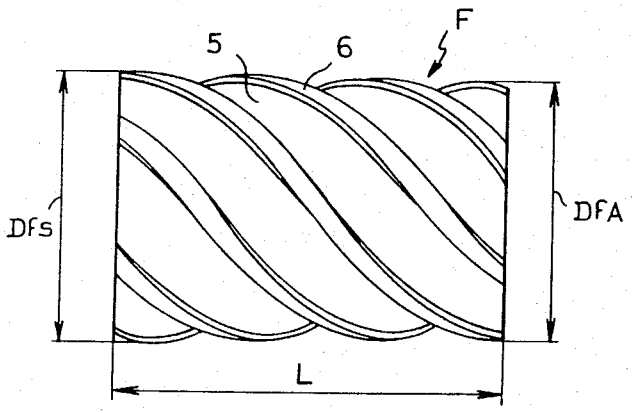
FIG. 2 is a side view of the female rotor.
Figure 6:
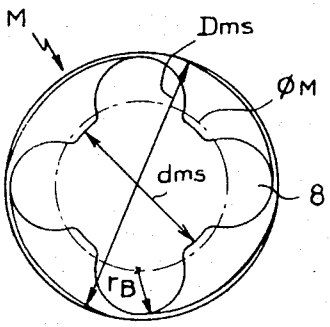
Figure 3:
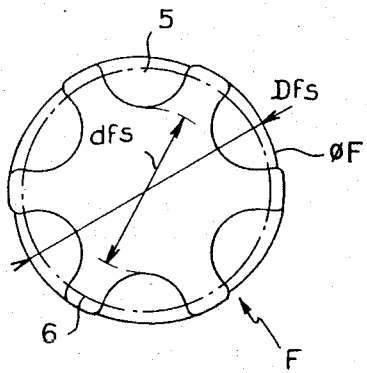

FIG. 1 shows how a male rotor M and a female rotor F which each have a slightly conical configuration and which are mounted in a housing 1 are assembled so as to overlap one another in opposition according to the invention. In the example illustrated, the male rotor M has, at its end adjacent the admission or inlet A of the housing, an outside diameter $D_{mA}$ and, at its opposite end adjacent the exhaust or outlet S of the housing, an outside diameter $D_{mS}$ less than the diameter $D_{mA}$. The female rotor F has, in turn, at its end on the admission side, a diameter $D_{fA}$ less than the diameter $D_{fS}$ at its end on the exhaust side. The two rotors F and M are assembled so as to intermesh in the housing 1 in such a way that their axes 2 and 3 respectively are parallel. Each rotor has a pitch diameter constant over its axial length, the pitch M and F (FIG. 6 and FIG. 3) diameters of the two rotors being different and the rotors being assembled in the housing so that their pitch diameters are tangent, as indicated by the tangential broken line 4 parallel to the axes 2 and 3 of the rotors. Each pitch diameter $\phi M$ and $\phi F$ defines a pitch cylinder, with the pitch cylinders tangent along tangential line 4 of FIG. 1 and line 4 being parallel to rotor axes 2 and 3. The pitch diameters or cylinders are constant and each rotor has a different number of threads or grooves relative to the other, and thus each rotor has a different but constant speed of rotation determined by timing gears having the same ratio of teeth or grooves. In the embodiment illustrated, the outside diameter $D_{mA}$ of the male rotor M is equal to the diameter $D_{fS}$ of the female rotor F, the opposite diameters $D_{mS}$ and $D_{fA}$ likewise being equal and the two rotors therefore having an identical conicity with an opening half angle of between 1 and 5 degrees, typically 2.2 to 2.5 degrees. According to a feature of the invention, the female rotor F has a groove profile 5, of which the radial depth in relation to the pitch diameter varies from one end of the rotor to the other in inverse proportion to those of the outside diameter $D_{fS}$–$D_{fA}$ of the female rotor. More specifically, the female rotor F incorporates six helical grooves 5, each having a cross-section with a circular profile, the radius of which increases progressively in the direction of reduction of the outside diameter $D_{fS}$–$D_{fA}$, the center of the radii remaining on the pitch cylinder defined by the respective pitch diameter of the female rotor. The result of this is that the diameters $D_{fS}$–$D_{fA}$ of the core and the circumferential thickness of the teeth 6 decrease in the same direction as the outside diameter $D_{fS}$–$D_{fA}$, as can be seen in FIGS. 1, 3 and 4. It thus emerges, in particular, that the diameters $D_{fS}$–$D_{fA}$ of the core, that is to say of the bottom 7 of the grooves 5, vary in the same direction and with the same conicity as the outside diameters $D_{fS}$–$D_{fA}$.

Figure 7:
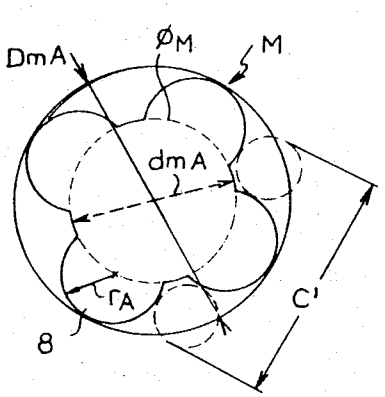
FIGS. 6 and 7 are the two end views of the male rotor of FIG. 5.

In a similar way, the male rotor M incorporates four helical lobes 8 with an opposite pitch to that of the female rotor, each lobe 8 having a cross-section with a circular profile, the radius of which is substantially identical, for each cross-section common to the two rotors, to that of the grooves of the female rotor, the center of each radius r of the lobes being located on the pitch cylinder defined by the pitch diameter $\phi_M$ of the male rotor M. Furthermore, as can be seen in FIGS. 4 and 7, for each cross-section of the female rotor F there is equality between the six dimensions C between the opposite ends of the circles osculating the section of minimum thickness of the teeth 6 and there is equality between the four dimensions C′ between the ends of the same osculating circles inscribed between two adjacent lobes 8 of the male rotor M. For each rotor, the transverse dimensions vary uniformly from the end of small diameter towards the end of large diameter.

The volumetric machine with screws according to the invention is designed more particularly for supplying slight overpressures of less than 1 bar, especially for use in the field of the volumetric supercharging of thermal motors. The rotors are advantageously made of plastic, for example, phenolic resin, polyamide with a glass filler or polyphenylene sulphide with glass and carbon fillers, as marketed under the brand name Ryton by Philips Petroleum, or they can even be made of light alloy, for example aluminium, such as T4-treated AU4G or T3- or T4-treated AU2GN. The rotors are preferably obtained by casting, starting from one metal pattern per rotor type, or possibly, in particular in the case of light alloys, by means of copying machines. Consequently, the rotors are advantageously hollow and are supported in the housing by shaft elements partially integrated in the rotors, as described in copending U.S. patent application No. 512,827 in the Applicant's name, the content of which is assumed to be incorporated here for reference purposes. As can be seen in FIG. 1, the chambers 10 and 12 of the housing 1 are shaped in such a way that the inner walls of these chambers match the outer profile of the associated rotors M and F.

For the mass production of such a volumetric machine with screws, the launching prototype of the rotors is provided in such a way that the rotors have a relatively substantial excess machining thickness at each axial end. The two rotors are then paired up, with the distance between the axes provided to ensure that the pitch diameters defining the cylinders are tangent, and by means of relative axial displacement of the two overlapping rotors, the axial wedging making it possible to ensure the desired play, for example of the order 1/10th of a millimeter, between the threads is sought. In this configuration with axial wedging defined in this way, the necessary material is removed by cutting at one end of each rotor or the other so as to bring the end faces of these respectively into a common plane, the distance L between these two end planes being used to give the inner chambers of the housing 1 their final dimensions, after which, on the basis of the dimensions determined in this way, mass production will guarantee that the desired play sought is maintained. Since the rotors are self-centered as a result of the conicity of the outside diameters, it is therefore possible to finish easily the molded axle of one rotor and the centering of the second axle with a high degree of accuracy in the dimensions and positioning.

Although the present invention has been described in relation to a particular embodiment, it is not limited thereby, but is on the contrary capable of modifications and alternative forms which will appear to a person skilled in the art.

We claim:

1. A volumetric machine with screws, including at least two rotors with intermeshing helical threads, the rotors being located with their axes parallel in intercommunicating chambers of a housing having inlet and outlet sides adjacent respective opposite axial ends of the rotors, each rotor having a conical outer profile and a pitch diameter which is constant over the axial length of the rotor, the rotors being mounted complementarily in the housing with an axial end of largest outer diameter of one rotor adjacent an axial end of smallest outer diameter of the other rotor, the rotors having their respective pitch diameters tangent along a tangential line parallel to the axes of the rotors.

2. The machine of claim 1, wherein the female rotor has grooves with radial depths, relative to the pitch diameter of the female rotor, that vary along the axial length of the female rotor in inverse proportion to the outer diameter of the female rotor.

3. The machine of claim 1, wherein each rotor has a core having the same conicity as the outer diameter over the axial length of the rotor.

4. The machine of claim 3, wherein lobes of the male rotor each have a circular profile of which the center for each transversal cross-section over the axial length of the male rotor is located on the pitch diameter of the male rotor.

5. The machine of claim 1, wherein chambers of the housing each have an inner profile parallel to the outer profile of the associated rotor.

6. The volumetric machine according to claim 1, wherein the rotors are produced by molding.

7. The volumetric machine according to claim 4, wherein the rotors are made of plastic.

8. The volumetric machine according to claim 1, wherein the rotors are produced by casting a light alloy.

* * * * *